US008829320B2

(12) United States Patent
Tahour

(10) Patent No.: US 8,829,320 B2
(45) Date of Patent: Sep. 9, 2014

(54) COLLAPSIBLE MUSICAL DRUM

(71) Applicant: Abdelilah Tahour, South Kissimmee, FL (US)

(72) Inventor: Abdelilah Tahour, South Kissimmee, FL (US)

( * ) Notice: Subject to any disclaimer, the term of this patent is extended or adjusted under 35 U.S.C. 154(b) by 0 days.

(21) Appl. No.: 13/748,962

(22) Filed: Jan. 24, 2013

(65) Prior Publication Data

US 2014/0202310 A1 Jul. 24, 2014

(51) Int. Cl.
*G10D 13/02* (2006.01)

(52) U.S. Cl.
CPC ..... *G10D 13/021* (2013.01)
USPC ..... 84/411 R

(58) Field of Classification Search
USPC ..... 84/411 R, 412
See application file for complete search history.

(56) References Cited

U.S. PATENT DOCUMENTS 4,300,437 A * 11/1981 Hinger et al. ..... 84/411 R
7,786,364 B2 * 8/2010 Natali ..... 84/412

* cited by examiner

*Primary Examiner* — Kimberly Lockett
(74) *Attorney, Agent, or Firm* — Oakwood Law Group, LLP

(57) ABSTRACT

A collapsible musical drum with collapsible drum shell is disclosed in the present invention. Said musical drum is comprised of a base drum member with a drum head and a drum shell, and a plurality of shell extension member which can be attached to the drum shell. The shell extension members attached to the drum shell can form a collapsible drum shell either in an extended, or a collapsed status. Thus the musical drum has an adjustable size of a resonate chamber formed by drum head and drum shell and thus produces various sounds. When in collapsed status, the musical drum can save spaces and is easier for transportation.

4 Claims, 6 Drawing Sheets

COLLAPSIBLE MUSICAL DRUM

BACKGROUND OF THE INVENTION

Field of the Invention

The present invention relates to a musical instrument. More particularly, the present invention relates to a musical drum, which has a collapsible drum shell and produces various of sounds.

Drums have been widely used as musical instruments with a very long history. Though drums may have taken various configurations, generally a conventional musical drum has a cylindrical drum shell with a upper end thereof open and covered with a drum head. The drum head consists of a circular elastic membrane that is attached to the drum shell. The drum head and drum shell together form a resonant chamber for producing a range of sounds, various with the diameter of the drum head membrane, tension of the membrane, and size of the chamber.

Each conventional musical drum usually produces one sound, though the pitch level of the sound may be altered by adjusting the tension of the drum head, as described, for example, in the U.S. Pat. No. 4,909,125 to Fece, or in the U.S. Pat. No. 3,185,013 to Gussalt. Also, Conventional musical drums also generally have a fixed sizes, transportation of big size drum is inconvenient and problematic. Thus it is the object of present invention to have a musical drum of which drum shell is collapsible so that the drum can produce various sounds and easy to transport.

SUMMARY OF THE INVENTION

In an exemplary embodiment of the present invention, there is disclosed a musical drum with a collapsible drum shell. As the size of said drum can be changed it creates different sounds from a functional standpoint and ease of carrying from a practicality point of view. Said drum is comprised of a drum base member comprising of a drum head and a drum shell, and a plurality of shell extension member. The shell extension member has a diameter smaller than that of the drum shell of the drum base member, and is slidably received by the drum shell of the drum base member. The second shell extension member has a diameter smaller than that of the first shell extension member, and is slidably received by the first shell extension member, and so on and so forth. Thus, the drum shell can either be in a extended status or a collapsed status. In this way, the drum has a resonate chamber of which size is adjustable and, thus produces various sound. When the musical drum is in its collapsed status, it saves space and makes the transportation of the musical drum an easier task. All of the collapsible parts of said invention function independently of one another. Therefore, it is possible to collapse one part independent of a second or third part or it is possible to collapse all parts simultaneously. A fully collapsing of all parts at the same time produces a compact instrument with extreme ease of transport.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
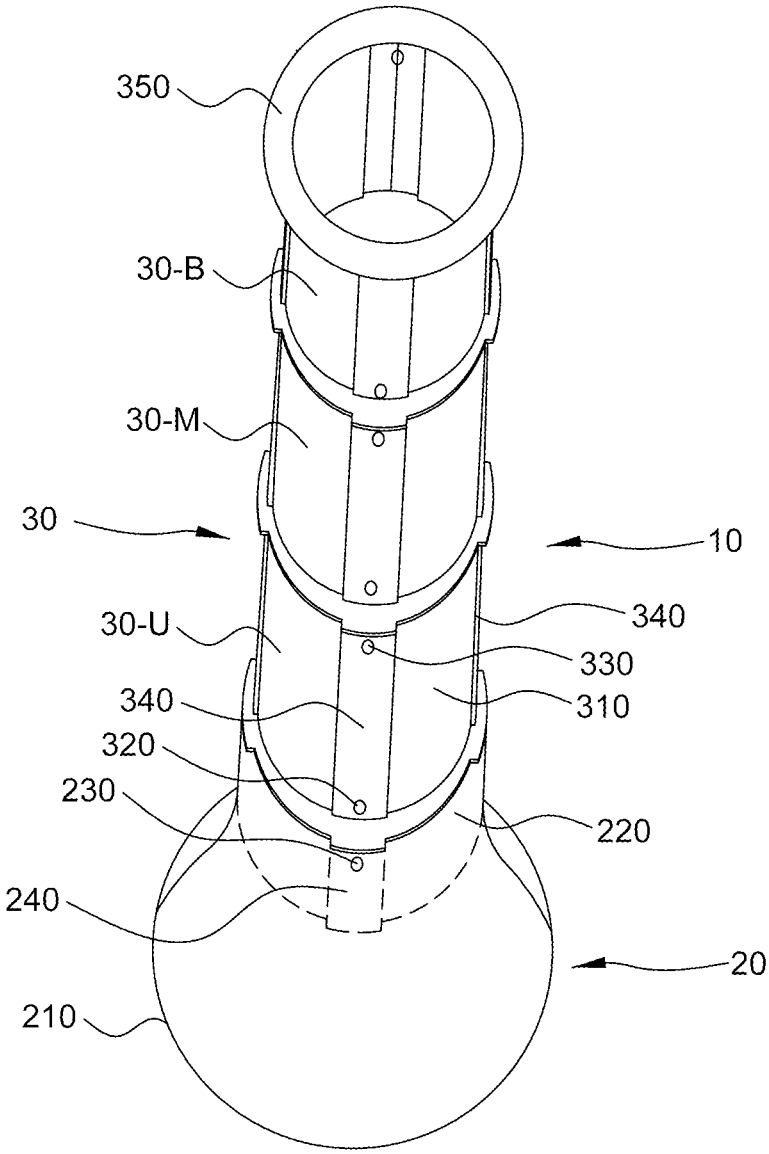
FIG. 1 is a perspective view of one embodiment of present invention in an extended status.
Figure 2:
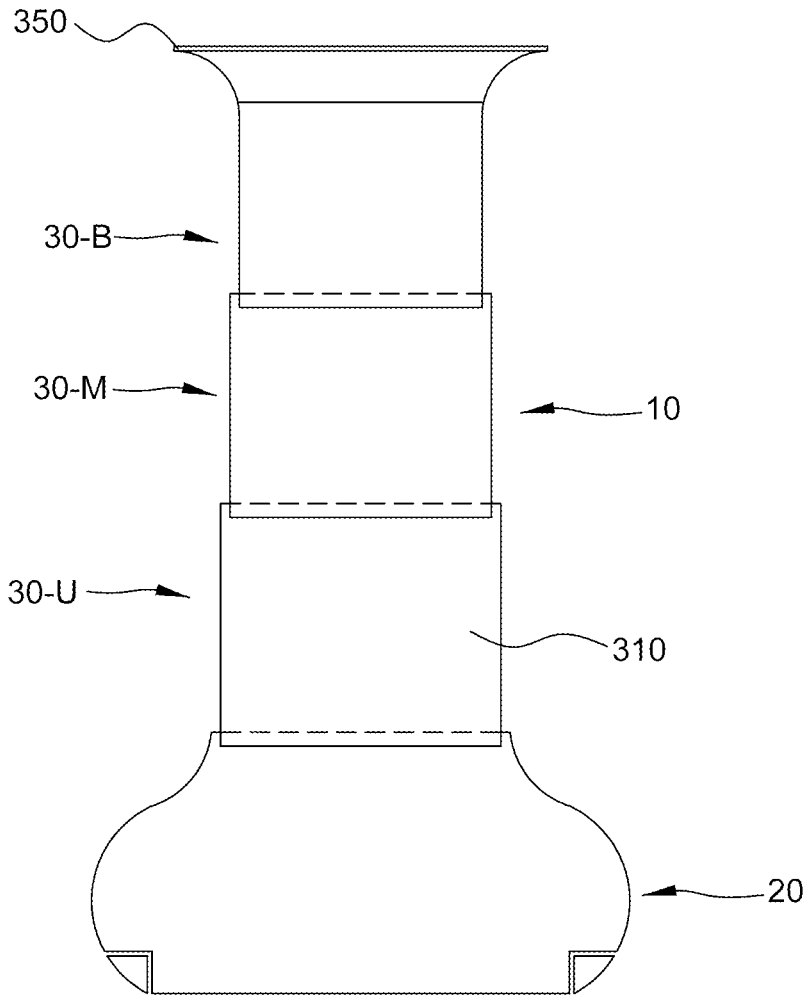
FIG. 2 is a cross-session view of one embodiment of present invention in an extended status as shown in FIG. 1.

Referring to FIG. 1-2, there is disclosed a musical drum with a collapsible drum shell.

Said drum 10 is comprised of a drum base member 20 comprising of a drum head 210 and a drum shell 220, and a plurality of shell extension member 30.

Figure 3:
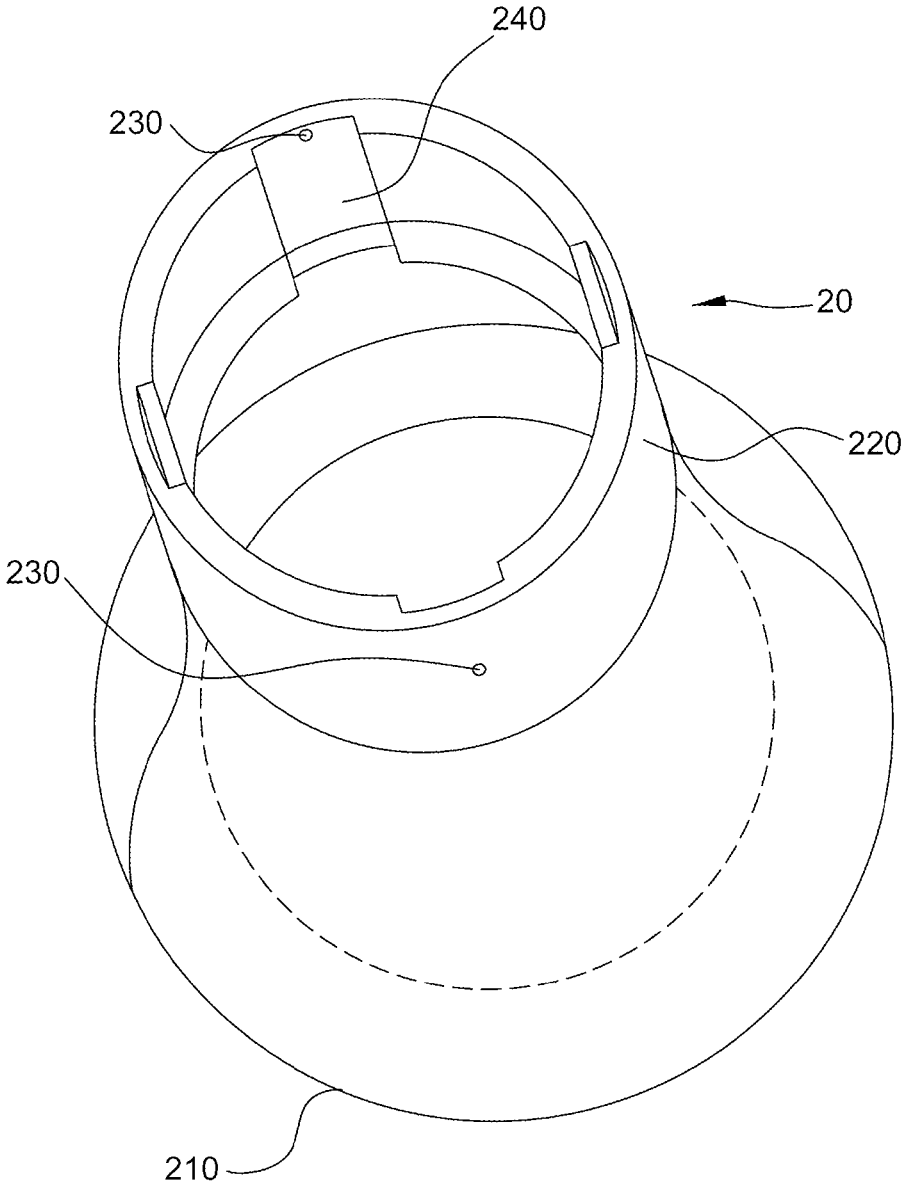
FIG. 3 is a perspective view of the drum base member of one embodiment of present invention.

As further illustrated in FIG. 1-3, the drum shell 220 of the drum base member 20 has receptor member 230 and sliding slots 240.

Figure 4:
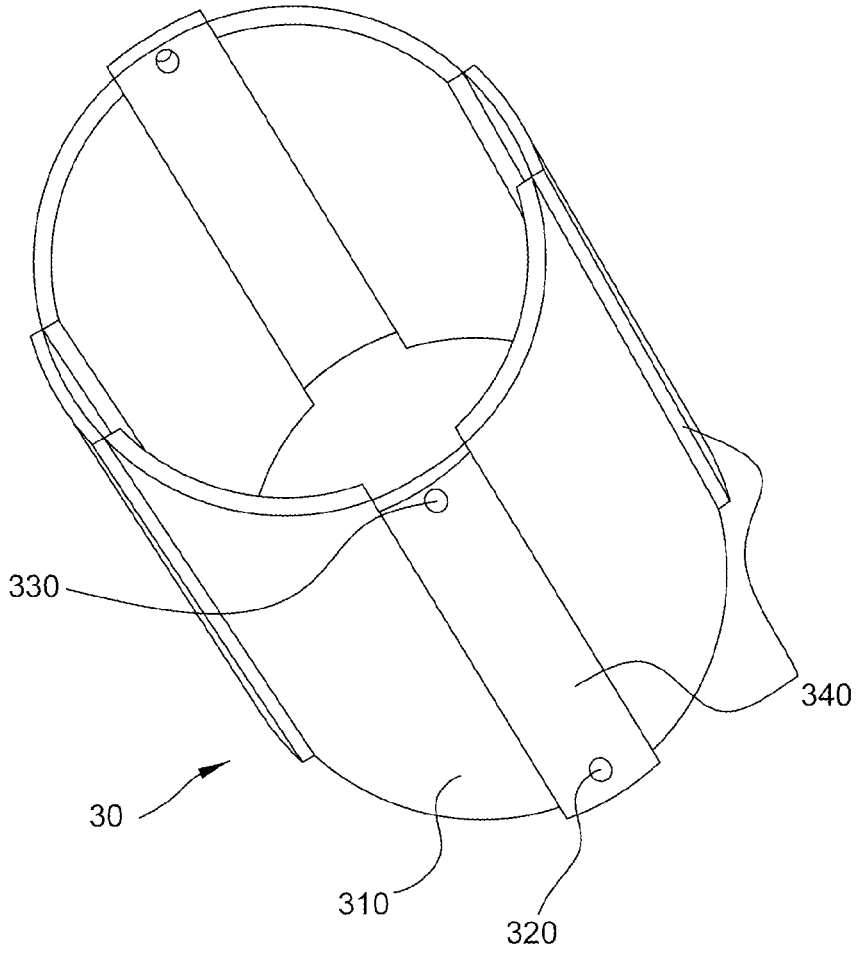
FIG. 4 is a perspective view of a shell extension member of one embodiment of present invention.

As further illustrated if FIGS. 1, 2, and 4, the shell extension member 30 has a shell 310, a locking member 320 a receptor member 330, and sliding slots 340.

Figure 6:
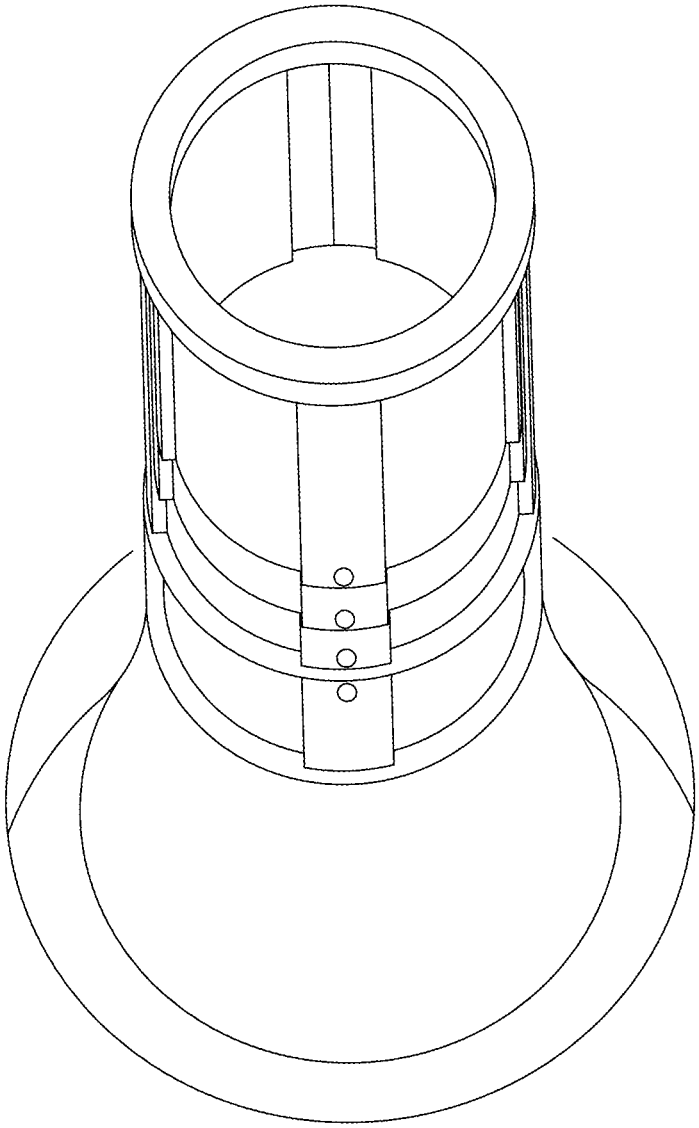
FIG. 6 is a perspective view of .one embodiment of present invention in a collapsed status.

The first shell extension member has a diameter smaller than that of the drum shell 220 of the drum base member 20, and is slidably received by the drum shell 220 of the drum base member 20. The receptor member 230 of the drum base member 20 receives the locking member 320 of shell extension member 30, allowing shell extension member 30 being secured with the shell 220 of the drum base member 20. The second shell extension member has a diameter smaller than that of the first shell extension member, and is slidably received by the first shell extension member, and so on and so forth Thus, the drum shell can either in a extended status, as shown in FIG. 1, or a collapsed status, as shown in FIG. 6. The number of shell extension member may vary as needed. In one embodiment of the present invention, three extension members are used, as shown in FIG. 1, 30-U, 30-M and 30-B. In this way, the drum has a resonate chamber of which size is adjustable and, thus produces various sound. When the musical drum is in its collapsed status, it saves spaces and makes the transportation of musical drum an easier task.

In one particular embodiment of the present invention, the shell of drum base member has a cylindrical shape.

In another embodiment of the present invention, the shell of shell extension member has a cylindrical shape.

In another embodiment of the present invention, as shown in FIG. 3, the drum base member has a cup-shape, with a cylindrical shell with a diameter smaller than that of the drum head.

Figure 5:
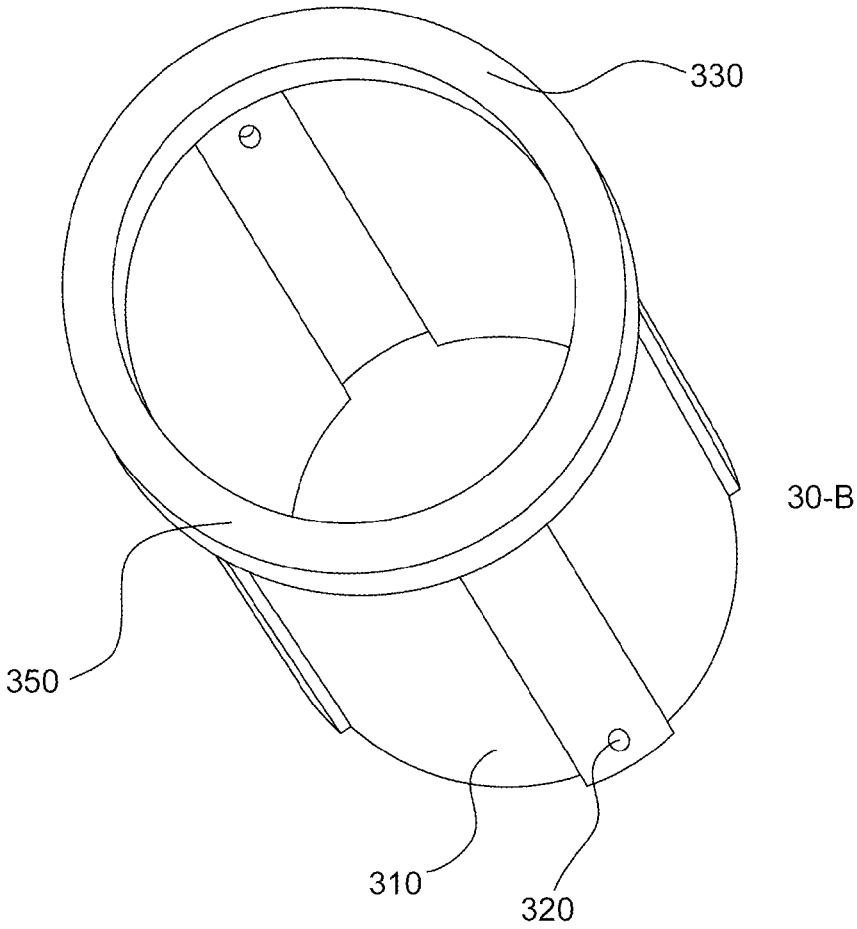
FIG. 5 is a perspective view of .a shell extension member of one embodiment of present invention with a base ring attached to it.

In another embodiment of the present invention, as shown in FIG. 3 and FIG. 5, the bottom edge of the last extension member has a base ring attached to it in order to keep the musical drum stable on a surface.

In another embodiment of the present invention, all and not just some of the drum chambers are able to collapse within one another to produce an extremely compact device for easy of carry.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A collapsible musical drum comprising:

a) a drum base member having a drum head and drum shell; and b) a plurality of shell extension member;

wherein said shell extension member has a diameter smaller than that of the drum shell of the drum base member, and is slidably received by the drum shell of the drum base member; and as numbers of shell extension member are used, second shell extension member has a diameter smaller than that of the first shell extension member, and is slidably received by the first shell extension member;

said drum shell of the drum base member is further comprised of a receptor member, which is a dent of the shell body, and an interior sliding slot which slidably receives shell extension member.

2. A collapsible musical drum of claim 1, wherein said shell extension member is further comprised of a locking member, which is a protrusion of the shell, a receptor member, which is a dent of the shell, and an interior sliding slot;

wherein the receptor member on drum shell of the drum base member receives the locking member on shell extension member to attach the shell extension member to drum base member; as numbers of shell extension member are used, the receptor member on the first shell extension member receives the locking member of second shell extension member to attach the second shell extension member to the first extension member in an extended status, and when unlocked, the second shell extension member collapse into the first shell extension member in a collapsed status.

3. A collapsible musical drum of claim 2, wherein the drum base member has a cup-shape, of which the drum shell has a diameter smaller than that of the drum head.

4. A collapsible musical drum of claim 2, wherein the last shell extension member has a base ring attached to it to keep said musical drum stable on a surface.

* * * * *